US005108354A

United States Patent [19]

Becker

[11] Patent Number: 5,108,354

[45] Date of Patent: Apr. 28, 1992

[54] BARBELL SUPPORT

[76] Inventor: Hermann J. Becker, Theodor-Heuss-Allee 18, D-500 Trier, Fed. Rep. of Germany

[21] Appl. No.: 653,604

[22] Filed: Feb. 11, 1991

[30] Foreign Application Priority Data

Feb. 2, 1990 [DE] Fed. Rep. of Germany ..... 9001637

[51] Int. Cl.[5] ..... A63B 21/072

[52] U.S. Cl. ..... 482/104

[58] Field of Search ..... 272/117, 118, 123, 134, 272/144, DIG. 4

[56] References Cited

U.S. PATENT DOCUMENTS

| | | | |
|---|---|---|---|
| 4,253,662 | 3/1981 | Podolak | 272/123 |
| 4,324,398 | 4/1982 | Hole | 272/123 |
| 4,561,651 | 12/1985 | Hole | 272/117 |
| 4,709,922 | 12/1987 | Slade, Jr. et al. | 272/123 |
| 4,875,676 | 10/1989 | Zimmer | 272/123 |
| 4,955,604 | 9/1990 | Pogue | 272/123 |
| 4,998,721 | 3/1991 | Anders et al. | 272/118 |

FOREIGN PATENT DOCUMENTS

| | | | |
|---|---|---|---|
| 735331 | 5/1966 | Canada | 272/117 |

*Primary Examiner*—Robert Bahr

*Attorney, Agent, or Firm*—Christensen, O'Connor, Johnson & Kindness

[57] ABSTRACT

Flexible cables extend upward from a carriage slidable along an upright column, then over guide pulleys and downward to a barbell. Latch mechanism interconnects the carriage with the column so as to support the weight of the barbell. The latch mechanism is releasable by actuation of an electromagnet to permit normal exercise by raising and lowering the barbell which causes corresponding lowering and raising of the carriage along the column.

13 Claims, 4 Drawing Sheets

BARBELL SUPPORT

BACKGROUND OF THE INVENTION

1. Field of the Invention

The present invention relates to a mechanical device attached to a barbell and permitting free movement of the barbell during exercise but actuatable to support the weight of the barbell at any desired time.

2. Prior Art

There are known racks and brackets for supporting a barbell when not in use. Nevertheless, sometimes it is not possible for a weight lifter to place a barbell in such a rack or bracket or to put the barbell down in a controlled manner after vigorously exercising almost to the limit of his or her strength. Consequently, there is a likelihood of a dangerous accident occurring.

SUMMARY OF THE INVENTION

The principal object of the present invention is to provide a barbell support which permits free mobility of the barbell during exercise but which assures its safe disposition following exercise.

In the preferred embodiment of the present invention, the foregoing object is accomplished by providing a support having an upright column with a carriage slidable along the column, one or more cables extending from the carriage over guide rollers supported from the column and connected to the barbell such that the carriage slides along the column as the barbell is moved during normal exercise, and a latch for interconnecting the carriage with the column so as to support the weight of the barbell following exercise.

In a preferred embodiment, the column has vertically spaced holes for a transversely slidable latch pin carried by the carriage. A spring biases the latch pin to a projected position in which it is received in one of the column holes. The latch pin is retractable by actuation of an electromagnet which applies a force opposing the force of the spring. Actuation of the electromagnet can be controlled by a switch mounted on the barbell bar for convenient access by the exerciser.

DETAILED DESCRIPTION

Figure 2:
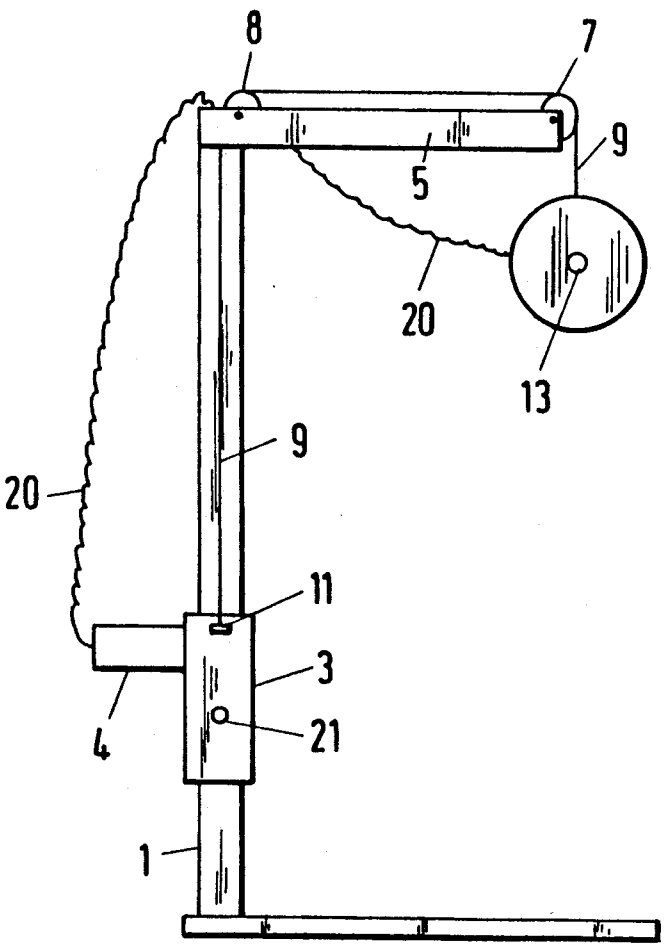
FIG. 2 is a diagrammatic side elevation of the support shown in FIG. 1.
Figure 1:
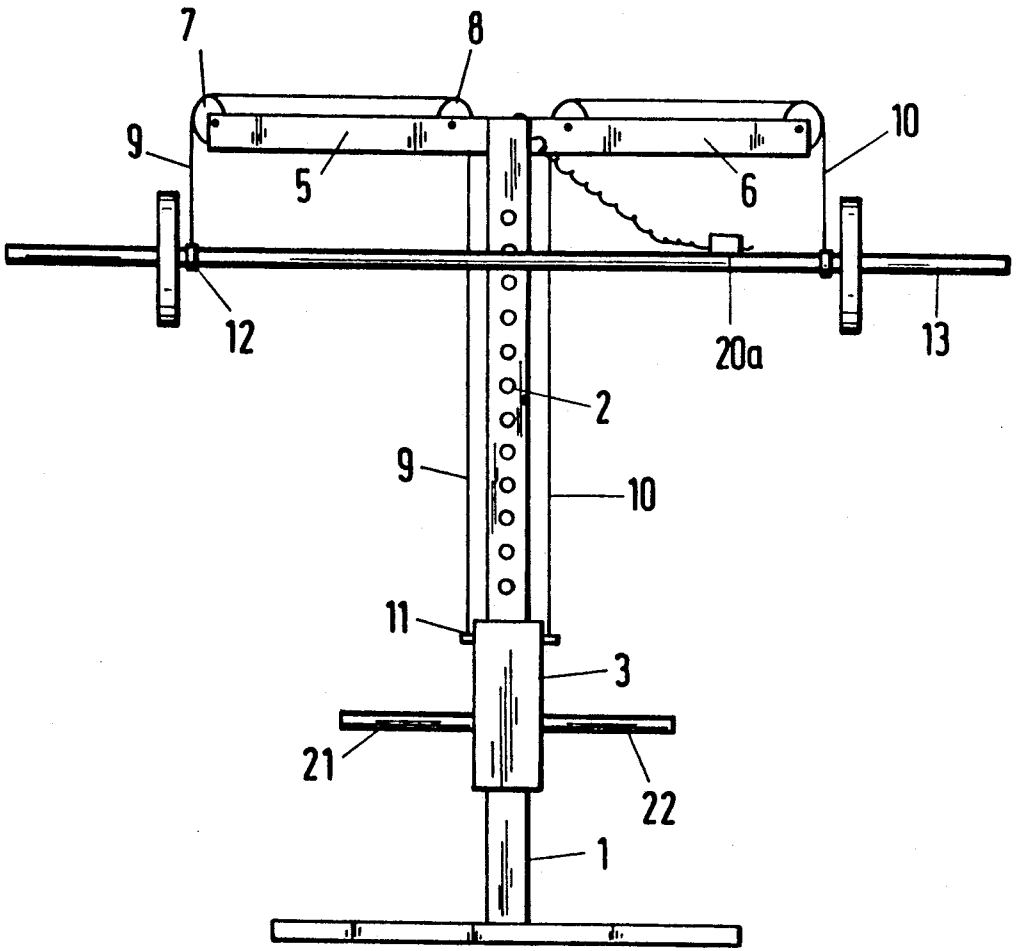
FIG. 1 is a diagrammatic front elevation of a barbell support in accordance with the present invention.

The barbell support in accordance with the present invention shown in FIGS. 1 and 2 includes an upright column 1 mounted on a suitable base. Column 1 has vertically spaced holes 2. A carriage 3 encircles and is slidable along the column 1. Latch mechanism 4 (FIG. 2) is mounted on the carriage.

Horizontal arms 5 and 6 are cantilevered from the upper end portion of the column 2 and extend outward and forward from it. A pulley 8 is mounted at the inner end portion of each arm and a pulley 7 is mounted at the outer end portion of each arm. Flexible cables 9 and 10 have corresponding ends 11 secured to the carriage 3. Each cable extends upward from the carriage over the inner and outer pulleys 8 and 7 of one arm 5 or 6, then downward to the bar 13 of a barbell. The cable ends 12 remote from ends 11 are fixed to the bar 13 at equal distances from its center toward its opposite ends, respectively.

The carriage 3 is biased downward by gravity and the weight of the carriage is small in comparison to the weight of the barbell. During normal exercise the carriage slides down along the column 1 as the exerciser lifts the barbell and slides up along the column as the weight lifter lowers the barbell. In accordance with the present invention, the latch mechanism 4 is actuatable to interlock the carriage with the column and prevent upward sliding movement of the carriage. Consequently, with the latch mechanism actuated, the exerciser can release the barbell and its full weight will be supported by the carriage interlocked with the column.

Figure 3:
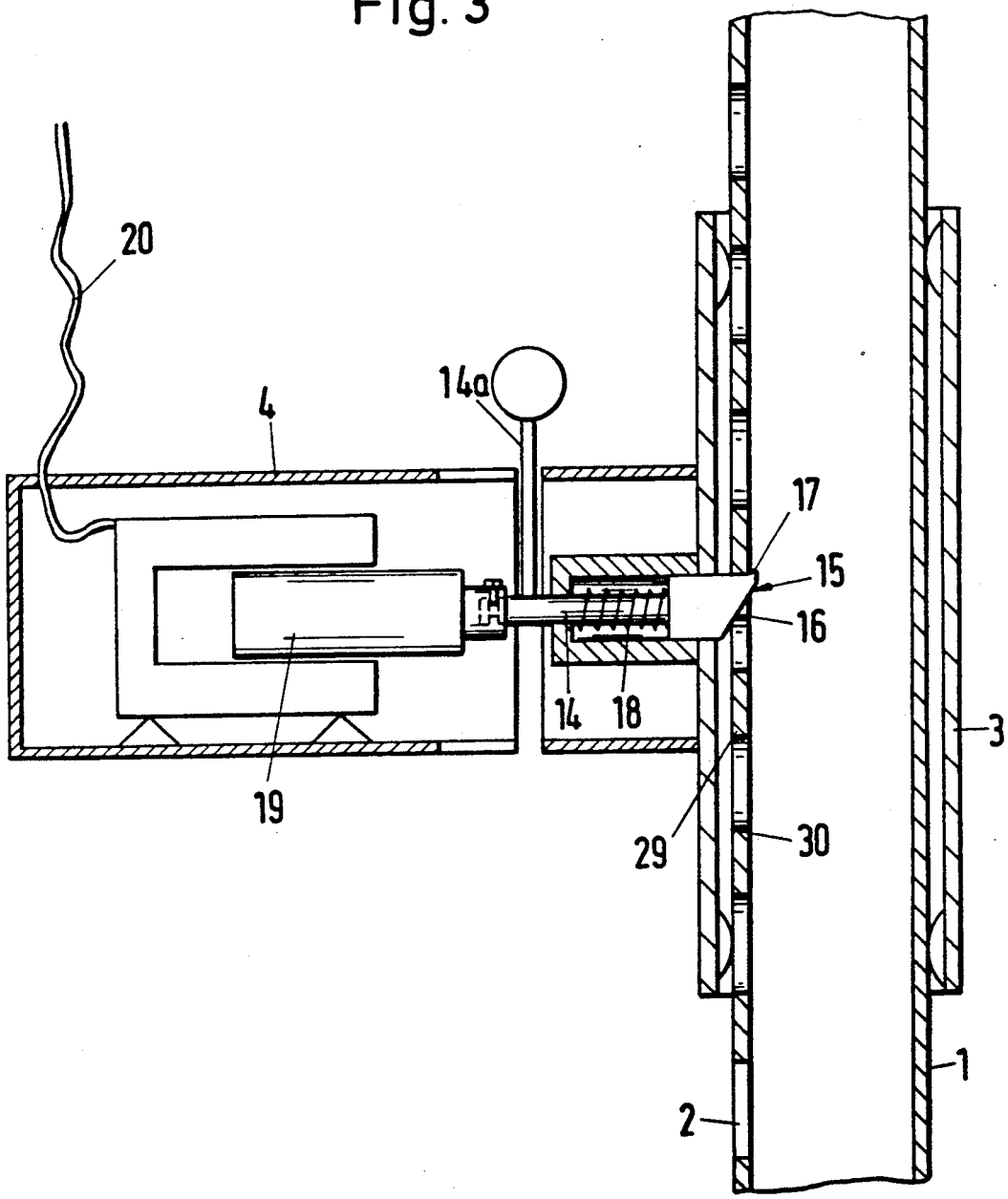
FIG. 3 is an enlarged fragmentary side elevation of a component of the support of FIGS. 1 and 2 with parts shown in section.

With reference to FIG. 3, in the preferred embodiment the latch mechanism 4 includes a housing mounted on the carriage 3. A latch pin 14 is mounted in the housing for horizontal sliding movement toward and away from the column 1. Pin 14 is biased by a compression spring 18 to the projected position shown in FIG. 3 in which the inner end portion 15 of the pin is received in one of the column holes 2. The underside of the pin 14 is beveled downward and outward away from its inner end. The pin includes a transversely projecting lip 17 at its inner end which lip extends oppositely from the beveled surface 16. In the position shown in FIG. 3, lip 17 extends upward alongside the top margin of the hole 2 in which the pin is received to assist in retaining the pin in its hole. The outer end portion of the pin is connected to an electromagnet assembly 19 having an actuating wire 20. The force of the electromagnet assembly is sufficient to retract the latch pin against the force of the compression spring to an unlocked position in which sliding movement of the carriage 3 relative to the column 1 is not restrained.

The electromagnet assembly is controlled by a switch such as switch 20*a* shown diagrammatically in FIG. 1. Switch 20*a* can be mounted on the barbell for convenient access by the user but preferably it also can be detached from the barbell for remote control of the latch mechanism.

As seen in FIG. 1, the carriage 3 can have oppositely extending horizontal shafts 21 and 22 onto which counterweights can be placed or removed to adjust the force required to raise the barbell without weights having to be added to or removed from the barbell bar.

In normal use, the electromagnet assembly 19 is actuated to retract the latch pin 14 so that the exerciser can freely raise and lower the barbell. At any desired time, the exerciser can by manipulation of the switch 20*a* turn off the electromagnetic assembly 19 such that the pin 14 is biased inward by the compression spring 18. The latch pin engages in the first hole 2 of the column 1 with which it is registered. The beveled surface 16 of the latch pin helps to ease the pin into a hole during downward movement of the carriage. Preferably, the upper edges 29 of the holes also are beveled for this purpose. In addition, preferably the weight of the carriage is sufficient that even with the electromagnet inoperative, lifting of the barbell causes the carriage to move downward and the latch pin will ratchet from one of the holes 2 to the next lower hole. Consequently, the beveled surface 16 of the pin preferably extends outward beyond the edge 30 of the column even when the pin is in its inward-projected position. Lip 17 of the latch pin prevents the electromagnet assembly from retracting the latch pin if the electromagnet is actuated inadvertently while the barbell is supported by the interlocked carriage and column. Before the latch pin can be retracted, either the barbell must be lifted slightly to lower the carriage or the latch pin must be rotated which preferably can be accomplished by a manual actuating handle 14*a* shown in FIG. 3.

Figure 4:
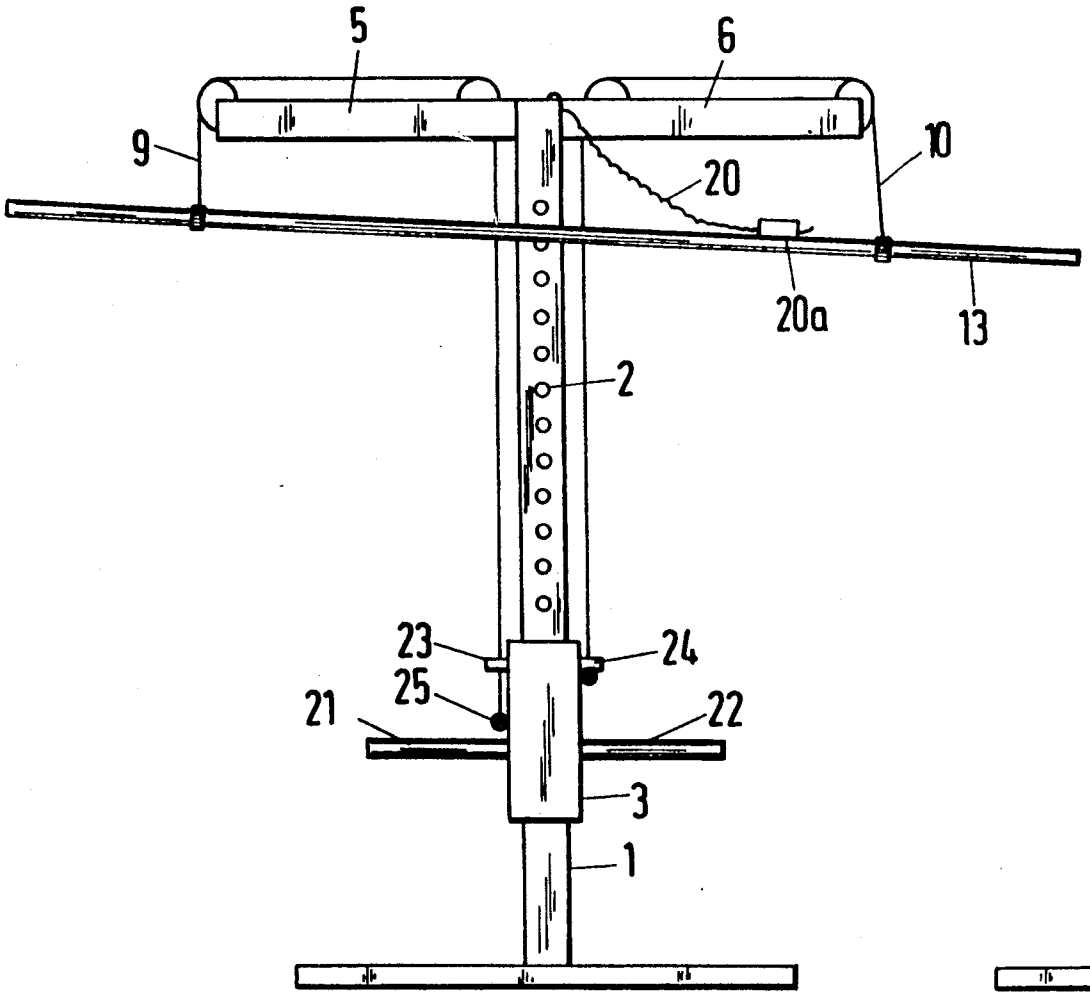
FIG. 4 is a front elevation of a modified barbell support in accordance with the present invention.

In the embodiment shown in FIG. 4, the end portions of the cables 9 and 10 adjacent to the carriage 3 extend through holes in lugs 23 and 24 which project oppositely from the upper end portion of the carriage. The bottom ends of the cables have enlargements 25 which prevent the cable ends from being removed upward through the lugs. When the carriage 3 is first latched to the column 1, if the barbell 13 is tilted, as indicated in FIG. 4, for example, the weight of the lower end portion of the bar is relieved first which usually will correspond to the weaker arm of the exerciser. Similarly, both ends of the barbell must be raised in order for the latch mechanism to be released.

Figure 5:
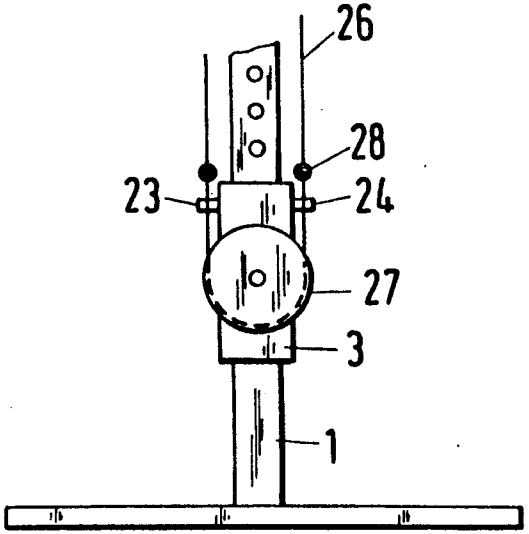
FIG. 5 is a fragmentary front elevation of a further modified barbell support in accordance with the present invention.

In the embodiment illustrated in FIG. 5, a single cable 26 extends around a guide roller or pulley 27 rotatably mounted on the carriage 3. Cable 26 extends through the lugs 23 and 24. Each upwardly extending stretch of the cable 26 has a fixed stop or enlargement 28 above the corresponding lug 23 or 24. Each stretch of the cable extends over the top pulleys and downward to a barbell as in the previously described embodiments. Operation of the embodiment of FIG. 5 is identical to operation of the embodiment of FIG. 4. Equal lifting or lowering movement of the barbell causes the carriage 3 to slide along its column 1, whereas if the barbell is tilted, one or the other of the enlargements 28 comes into contact with its lug 23 or 24.

Figure 6:
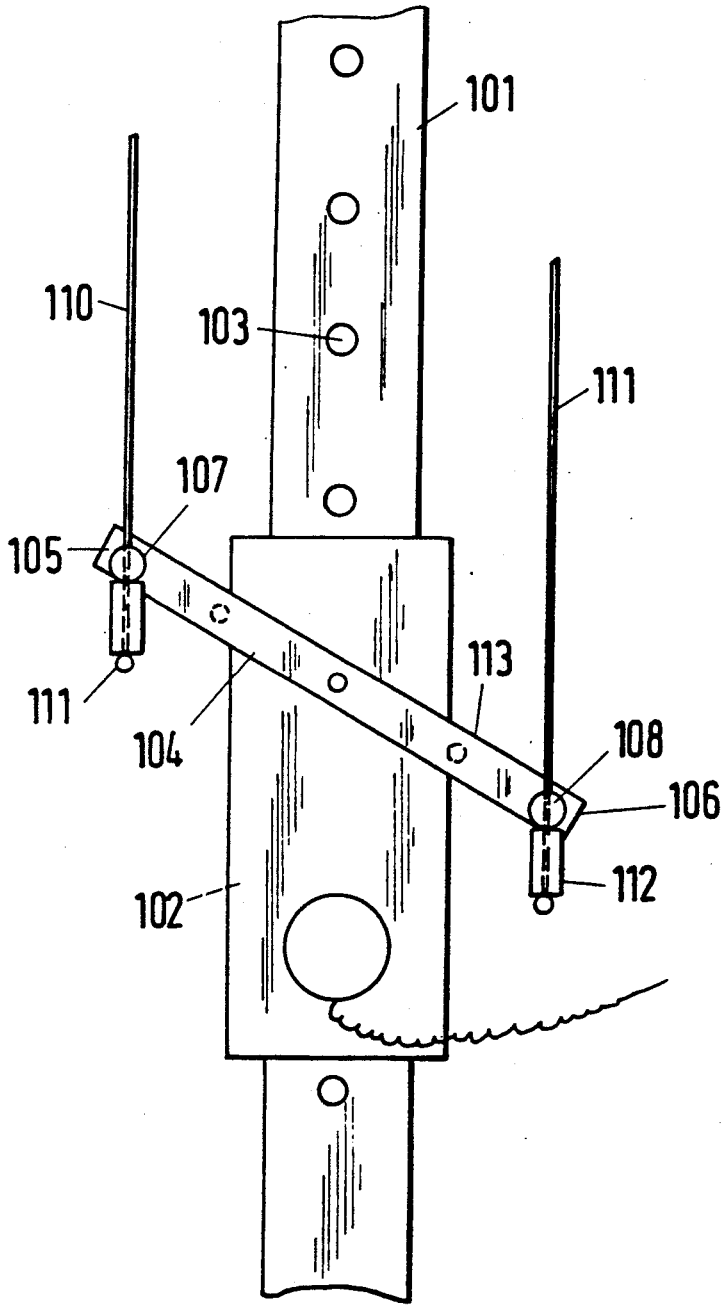
FIG. 6 is an enlarged fragmentary rear elevation of another embodiment of barbell support in accordance with the present invention.

In the embodiment shown in FIG. 6, a carriage 102 is slidable vertically along an upright column 101 having vertically spaced holes 103. As for the previously described embodiment, latch mechanism includes a latch pin insertable into and retractable from the holes 103.

An elongated link 104 has its center pivoted to the carriage 102. Lugs 107 and 108 are rotatably mounted on the opposite end portions 105 and 106, respectively, of the link. Cables 110 and 111 extend through the lugs 107 and 108. Resilient spacers 112 are fitted between the lugs and enlarged end portions of the cable. Swinging movement of the link 104 relative to the carriage is limited by stops 113 which project transversely from the link and which are engageable against opposite sides of the carriage.

In other respects the embodiment of FIG. 6 is the same as the previously described embodiments.

In use, if the barbell is tilted initially, link 104 will swing without any movement or force transference through the carriage. If a predetermined angle is exceeded, however, the link is swung sufficiently that the stops 113 engage the carriage and the lower end of the barbell (corresponding to the higher end of the link) counterbalances the higher end of the barbell.

I claim:

1. In exercise equipment including a barbell and a support for the barbell, the improvement comprising the support including the combination of an upright column, said column having vertically spaced holes, a carriage slidable along said column, means interconnecting the barbell and said carriage such that lifting movement of the barbell normally lowers said carriage and lowering movement of the barbell raises said carriage, and latch means for locking said carriage on said column so as to prevent upward movement of said carriage such that said carriage is effective to support the weight of the barbell, said latch means including a latch pin carried by said carriage and movable transversely of said column in alignment with said holes, spring means for biasing said latch pin to a projected locking position in which said latch pin is received in one of said holes of said column for locking said carriage to said column, and an electromagnet actuatable to retract said latch pin in opposition to the force of said spring means.

2. In the equipment defined in claim 1, the latch means including a switch mountable on the barbell and effective to control actuation of the electromagnet.

3. In the equipment defined in claim 2, the switch being removable from the barbell for remote control.

4. In the equipment defined in claim 1, the latch pin having an inner end portion with an underside beveled downward and outward relative to the column.

5. In the equipment defined in claim 4, the latch pin having an inner end portion with an upward-projecting lip for retaining the latch pin in a hole of the column.

6. In the equipment defined in claim 5, the latch pin being rotatable to adjust the position of the lip relative to the column.

7. In the equipment defined in claim 1, the carriage having oppositely projecting counterweight shafts.

8. In the equipment defined in claim 1, the interconnecting means including at least one flexible cable, the carriage having a lug including a bore, said cable being threaded through said bore and having an enlarged end of a diameter greater than the diameter of said bore for retaining said cable in said lug.

9. In the equipment defined in claim 1, the support including a guide pulley mounted on the carriage, the interconnecting means including a single cable having a central portion extending around said pulley and opposite end portions extending from said pulley, respectively, to the barbell.

10. In the equipment defined in claim 2, the interconnecting means including two flexible cables each having an end portion connected to the barbell, and including an elongated link having a central portion pivoted to the carriage, the end portions of said cables opposite the portions connected to the barbell being connected to the opposite end portions of said link, respectively.

11. In the equipment defined in claim 10, stop means limiting the degree of swinging movement of the link relative to the carriage.

12. In the equipment defined in claim 10, two lugs rotatably mounted on the opposite ends of the link, respectively, and receiving the adjacent end portions of the cables.

13. In the equipment defined in claim 12, spacers of flexible material carried by the cable end portions adjacent to the lugs.

* * * * *

UNITED STATES PATENT AND TRADEMARK OFFICE

CERTIFICATE OF CORRECTION

PATENT NO. : 5,108,354

DATED : April 28, 1992

INVENTOR(S) : H.J. Becker

It is certified that error appears in the above-identified patent and that said Letters Patent is hereby corrected as shown below:

| COLUMN | LINE | |
|---|---|---|
| 4 | 50 | "Claim 2" should read --Claim 1-- |

Signed and Sealed this

Seventh Day of September, 1993

Bruce Lehman

*Attest:*

BRUCE LEHMAN

*Attesting Officer*

*Commissioner of Patents and Trademarks*